US012038020B2

(12) United States Patent
Whyte et al.

(10) Patent No.: US 12,038,020 B2
(45) Date of Patent: Jul. 16, 2024

(54) DIFFUSER

(71) Applicant: HOWDEN NETHERLANDS B.V., Hengelo (NL)

(72) Inventors: William Murray Whyte, Glasgow (GB); Peter Holkers, Hengelo (NL)

(73) Assignee: HOWDEN AXIAL NETHERLANDS B.V., Hengelo (NL)

( * ) Notice: Subject to any disclaimer, the term of this patent is extended or adjusted under 35 U.S.C. 154(b) by 0 days.

(21) Appl. No.: 17/992,108

(22) Filed: Nov. 22, 2022

(65) Prior Publication Data

US 2023/0082029 A1 Mar. 16, 2023

Related U.S. Application Data

(63) Continuation of application No. PCT/IB2020/055042, filed on May 27, 2020.

(51) Int. Cl.
*F04D 29/54* (2006.01)
*F04D 19/00* (2006.01)

(52) U.S. Cl.
CPC ..... *F04D 29/541* (2013.01); *F04D 19/002* (2013.01)

(58) Field of Classification Search
CPC ..... F04D 23/329; F04D 19/002
See application file for complete search history.

(56) References Cited

U.S. PATENT DOCUMENTS 2,555,576 A 6/1951 Criqui
5,685,696 A * 11/1997 Zangeneh ..... F04D 29/284 416/186 R
5,730,583 A * 3/1998 Alizadeh ..... F04D 29/386 416/189
7,029,234 B2 4/2006 Jensen
7,168,918 B2 1/2007 Balan et al.
7,478,993 B2 1/2009 Hong et al.
7,780,408 B2 8/2010 Lazzarato et al.
8,747,063 B2 * 6/2014 Tingler ..... F04D 29/2205 415/199.2
9,366,148 B2 6/2016 Clemen
9,624,930 B2 4/2017 Gahlot et al.
2004/0146400 A1 * 7/2004 Robb ..... F04D 29/544 415/211.2
2007/0022738 A1 2/2007 Norris et al.
(Continued)

FOREIGN PATENT DOCUMENTS

EP 3351718 A1 7/2018
FR 1198108 A 12/1959

OTHER PUBLICATIONS

Notification of Transmittal of the International Search Report and Written Opinion including International Search Report and Written Opinion for International Application No. PCT/IB2020/055042 dated Feb. 15, 2021, 14 pages.
(Continued)

*Primary Examiner* — Long T Tran
(74) *Attorney, Agent, or Firm* — Edell, Shapiro & Finnan, LLC

(57) ABSTRACT

A diffuser and method of diffusing a working fluid is disclosed. The assembly includes a shroud, and a hub disposed within the shroud. The hub includes an upstream portion, a downstream portion having a recess extending axially into the hub, the hub being configured to diffuse a flow of fluid downstream of the hub.

21 Claims, 12 Drawing Sheets

(56) References Cited

U.S. PATENT DOCUMENTS

| | | | | |
|---|---|---|---|---|
| 2008/0107524 | A1 | 5/2008 | Chang et al. | |
| 2009/0263238 | A1* | 10/2009 | Jarrah | F04D 29/544 415/199.5 |
| 2009/0269196 | A1* | 10/2009 | Hsu | F04D 29/54 415/211.2 |
| 2010/0215485 | A1* | 8/2010 | Childe | F04D 29/4226 415/203 |
| 2011/0129346 | A1 | 6/2011 | Jarrah et al. | |
| 2012/0121410 | A1* | 5/2012 | Liu | F04D 29/329 415/220 |
| 2015/0167692 | A1* | 6/2015 | Kobayashi | F04D 29/541 415/208.1 |
| 2018/0258959 | A1 | 9/2018 | Honda et al. | |
| 2019/0170158 | A1* | 6/2019 | Azzouz | F04D 19/002 |
| 2019/0211843 | A1* | 7/2019 | Dygert | F04D 25/12 |
| 2020/0063576 | A1* | 2/2020 | Kim | F04D 29/2222 |
| 2020/0392961 | A1* | 12/2020 | Holenstein | F04D 19/002 |

OTHER PUBLICATIONS

Examination Report No. 1 for Australian Patent Application No. 2020449612 dated Jan. 12, 2024, 4 pages.

* cited by examiner

DIFFUSER

CROSS-REFERENCE TO RELATED APPLICATIONS

This application is a continuation of International Patent Application No. PCT/IB2020/055042, filed May 27, 2020, the entire contents of which is incorporated herein by reference.

FIELD OF INVENTION

The present invention relates to the field of axial fan assemblies and, in particular, a hub configured to diffuse fan outlet fluid.

BACKGROUND

In turbomachinery, it is desirable to maximize the recovery of static pressure at the outlet. An impeller or fan rotating on its own has a flow regime that causes large dynamic pressure losses at the exit of the assembly and therefore reduces the static pressure recovery. This flow regime can be characterized by 1) a circumferentially rotating flow exiting the fan and 2) a near-hub recirculating flow that is sometimes known as "hub dead water." Guide vanes disposed downstream of the impeller have been used redirect the circumferentially rotating flow. The guide vanes convert rotating velocity component of the flow into static pressure. Diffusers have also been used to decrease the velocity and increase the uniformity of the outlet flow. Thus, diffusers can convert the dynamic pressure into static pressure.

Guide vane hubs may reduce efficiency of the overall system by causing a portion of the outlet flow near the vane hub to recirculate or flow back into the vanes at the outlet. Diffusers may not reduce the back flow, or hub dead water, and may increase the overall size of the fan assembly. Additionally, hub dead water may cause the back flow and choke the flow through the fan, guide vanes, and/or diffuser In view of at least the aforementioned issues, a system for reducing hub dead water and improving static pressure recovering is desirable.

SUMMARY

The present invention relates to an axial fan assembly. In accordance with at least one embodiment of the present invention, an assembly includes a shroud having a substantially uniform radius along an axial length and a hub disposed within the shroud. The hub includes an upstream portion; a downstream portion having a recess extending axially into the hub, the downstream portion being configured to diffuse a flow of fluid downstream of the hub; and vanes radially extending between the hub and the shroud.

In accordance with at least one embodiment of the present invention, an assembly includes a shroud having a substantially uniform radius along an axial length, a hub and an axial fan having an axis of rotation aligned a center axis of the hub disposed within the shroud. The hub includes an upstream portion; a downstream portion having a recess extending axially into the hub, the downstream portion being configured to diffuse a flow of fluid downstream of the hub; and vanes radially extending between the hub and the shroud.

In accordance with at least one embodiment of the present invention, an assembly includes a shroud having a substantially uniform radius along an axial length, a hub and an axial fan having an axis of rotation aligned a center axis of the hub disposed within the shroud. The hub includes an upstream portion; a downstream portion having a recess extending axially into the hub, the downstream portion being configured to diffuse a flow of fluid downstream of the hub; and vanes radially extending between the hub and the shroud. The axial fan is disposed upstream from the hub. The upstream portion of the hub is configured to accelerate the flow of fluid towards an outer circumference of the hub.

In accordance with at least one embodiment of the present invention, an assembly includes a shroud having a substantially uniform radius along an axial length, a hub and an axial fan having an axis of rotation aligned a center axis of the hub disposed within the shroud. The hub includes an upstream portion; a downstream portion having a recess extending axially into the hub, the downstream portion being configured to diffuse a flow of fluid downstream of the hub; and vanes radially extending between the hub and the shroud. An axial distance between a leading edge of the fan and upstream end of the hub may be about 10% to 60% a radius of the fan.

In accordance with at least one embodiment of the present invention, an assembly includes a shroud having a substantially uniform radius along an axial length, a hub and an axial fan having an axis of rotation aligned a center axis of the hub disposed within the shroud. The hub includes an upstream portion; a downstream portion having a recess extending axially into the hub, the downstream portion being configured to diffuse a flow of fluid downstream of the hub; and vanes radially extending between the hub and the shroud. A radius of the hub may be about 45% of a radius of the fan.

In accordance with at least one embodiment of the present invention, an assembly includes a shroud having a substantially uniform radius along an axial length, a hub and an axial fan having an axis of rotation aligned a center axis of the hub disposed within the shroud. The hub includes an upstream portion; a downstream portion having a recess extending axially into the hub, the downstream portion being configured to diffuse a flow of fluid downstream of the hub; and vanes radially extending between the hub and the shroud. The hub further includes a recirculation channel having a channel inlet at the recess and a channel outlet at the upstream portion of the hub. The recirculation channel may be configured to guide a recirculation flow from the channel inlet, through the hub, to the channel outlet. The channel outlet may be configured to direct the recirculation flow towards the center axis of the axial fan. The channel outlet may be further configured to swirl the recirculation flow in a direction of rotation of the axial fan.

In accordance with at least one embodiment of the present invention, a method of diffusing a flow of fluid includes inducing a flow of fluid via an axial fan; directing the flow toward a hub having guide vanes; accelerating a first portion of the flow along an upstream end of the hub and towards the guide vanes; and rectifying the flow via the guide vanes. After rectifying the flow via the guide vanes, guiding a second portion of the flow of fluid towards a recess in a downstream portion of the hub, wherein guiding the second portion of the flow diffuses a third portion of the flow radially inward.

In accordance with at least one embodiment of the present invention, a method of diffusing a flow of fluid includes inducing a flow of fluid via an axial fan; directing the flow toward a hub having guide vanes; accelerating a first portion of the flow along an upstream end of the hub and towards the guide vanes; and rectifying the flow via the guide vanes.

After rectifying the flow via the guide vanes, guiding a second portion of the flow of fluid towards a recess in a downstream portion of the hub, wherein guiding the second portion of the flow diffuses a third portion of the flow radially inward. The second portion of the flow may be a recirculation flow. The method may further include guiding the recirculation flow from the recess through the hub via a recirculation channel; and ejecting the recirculation flow from the recirculation channel towards the axial fan. The method may further include swirling the recirculation flow in a direction of rotation of the axial fan. Swirling the recirculation flow may include directing the recirculation flow via a vane. Alternatively, or additionally, swirling the recirculation flow may include directing the recirculation flow via a plurality of channel outlets of the recirculating channel, the plurality of channel outlets being angled towards a direction of rotation of the axial fan. Alternatively, or additionally, swirling the recirculation flow may include directing the recirculation flow via a plurality of channel outlets of the recirculating channel, the plurality of channel outlets being angled towards a direction of rotation of the axial fan.

In accordance with at least one embodiment of the present invention, a method of diffusing a flow of fluid includes inducing a flow of fluid via an axial fan; directing the flow toward a hub having guide vanes; accelerating a first portion of the flow along an upstream end of the hub and towards the guide vanes; and rectifying the flow via the guide vanes. After rectifying the flow via the guide vanes, guiding a second portion of the flow of fluid towards a recess in a downstream portion of the hub, wherein guiding the second portion of the flow diffuses a third portion of the flow radially inward. Guiding a recirculation flow of the flow of fluid towards a recess in a downstream portion of the hub maintains a uniform or unidirectional flow through the vanes.

In accordance with at least one embodiment of the present invention, an assembly includes a shroud; a hub disposed within the shroud, the hub including an upstream portion, a downstream portion having a recess extending axially into the hub, a recirculation channel extending from the recess to the upstream portion, the channel being configured to diffuse a flow of fluid downstream of the hub; and vanes radially extending between the hub and the shroud.

In accordance with at least one embodiment of the present invention, an assembly includes a shroud; a hub disposed within the shroud, the hub including an upstream portion, a downstream portion having a recess extending axially into the hub, a recirculation channel extending from the recess to the upstream portion, the channel being configured to diffuse a flow of fluid downstream of the hub; and vanes radially extending between the hub and the shroud. The recirculation channel includes a channel inlet at the recess and a channel outlet at the upstream portion of the hub, the recirculation channel may be configured to guide a recirculation flow from the channel inlet, through the hub, to the channel outlet. The channel outlet may be configured to direct the recirculation flow towards a center axis of an axial fan disposed upstream of the hub. The channel outlet may be further configured to swirl the recirculation flow in a direction of rotation of the axial fan. The channel outlet may further include one or more vanes.

In accordance with at least one embodiment of the present invention, an assembly includes a shroud; a hub disposed within the shroud, the hub including an upstream portion, a downstream portion having a recess extending axially into the hub, a recirculation channel extending from the recess to the upstream portion, the channel being configured to diffuse a flow of fluid downstream of the hub; and vanes radially extending between the hub and the shroud. The hub may further include a plurality of recirculation channels, including the recirculating channel. Each recirculating channel of the plurality of recirculating channels may have a channel inlet at the recess and a channel outlet at the upstream portion of the hub. The plurality of recirculation channels may be configured to guide a recirculation flow from the channel inlets, through the hub, to the channel outlets. The channel outlets may be angled towards a direction of rotation of the axial fan, the channel outlets are configured eject the recirculation flow toward the axial fan in the direction of rotation of the axial fan.

BRIEF DESCRIPTION OF THE DRAWINGS

To complete the description and in order to provide for a better understanding of the present invention, a set of drawings is provided. The drawings form an integral part of the description and illustrate an embodiment of the present invention, which should not be interpreted as restricting the scope of the invention, but just as an example of how the invention can be carried out. The drawings comprise the following figures.

DETAILED DESCRIPTION

The following description is not to be taken in a limiting sense but is given solely for the purpose of describing the broad principles of the invention. Embodiments of the invention will be described by way of example, with reference to the above-mentioned drawings showing elements and results according to the present invention.

Generally, the efficiency of a fan, or static efficiency, is determined based on the amount of power supplied to the fan, the static pressure and total pressure, e.g., static and dynamic pressure, and output from the fan. Thus, the more dynamic pressure that is converted to static pressure the more efficient the fan may be. That is, converting the velocity of the flow into static pressure downstream of the fan improves static efficiency.

The axial fan assembly presented herein includes a fan and hub assembly configured to reduce backflow through the assembly and diffuse the outlet flow to convert dynamic pressure to static pressure. The hub is sized and arranged such that a flow of working fluid, e.g. air, near a center axis of the fan is accelerated radially outward along the hub. The accelerated flow travels along the hub from an upstream end to a downstream end of the hub. At the downstream end, the flow follows the contours of the hub radially inward, creating a pocket of recirculating flow immediately downstream of the hub. The pocket of recirculating flow pulls a portion of the outlet flow radially inward, thus diffusing the outlet flow and converting a substantial portion of the dynamic pressure into static pressure with little or no backflow. Thus, a fan having desirable static efficiency can be achieved without the use of a large diffuser.

Figure 1A:
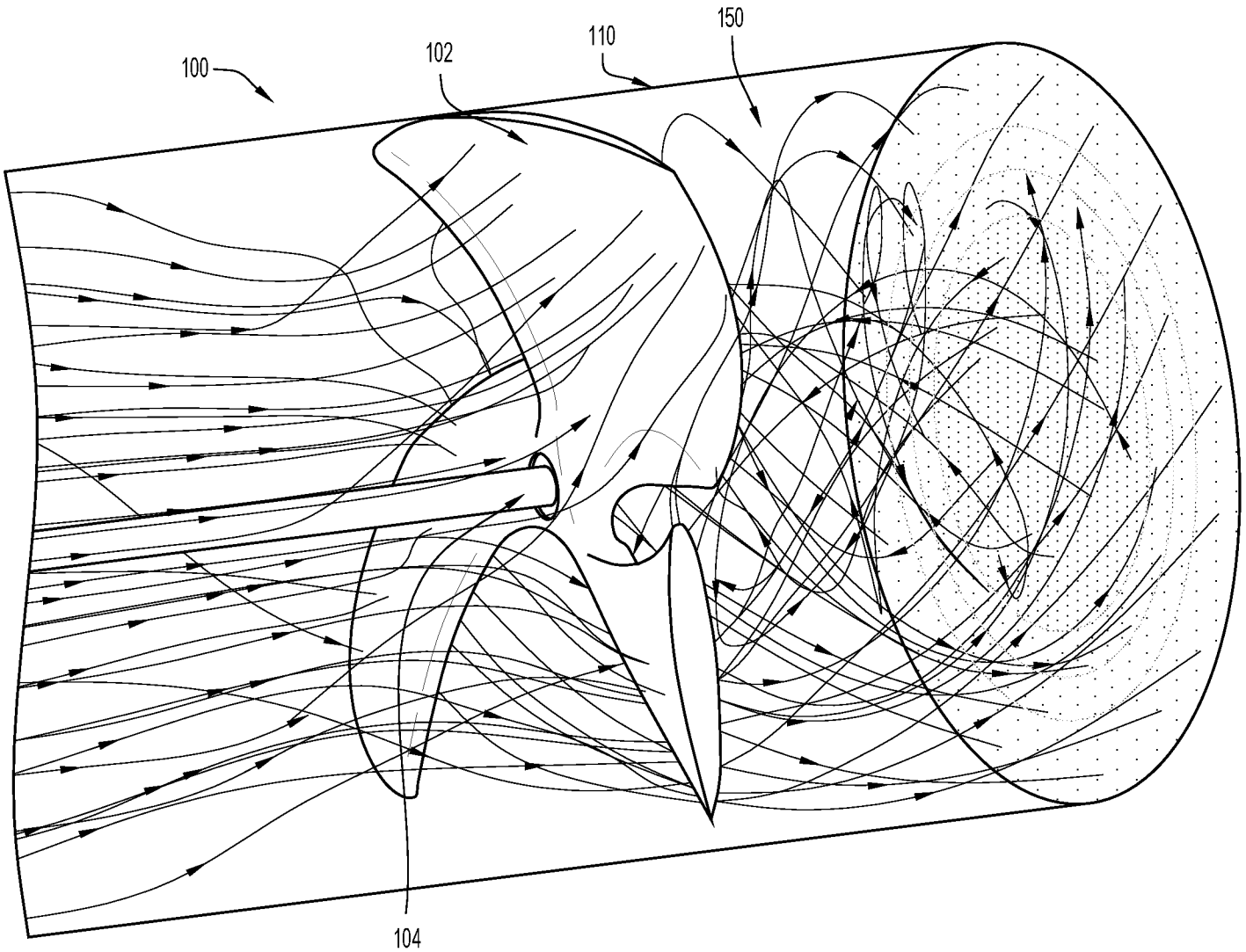
FIG. 1A is a perspective view of an axial fan assembly illustrated with fan flow characteristics.
Figure 1B:
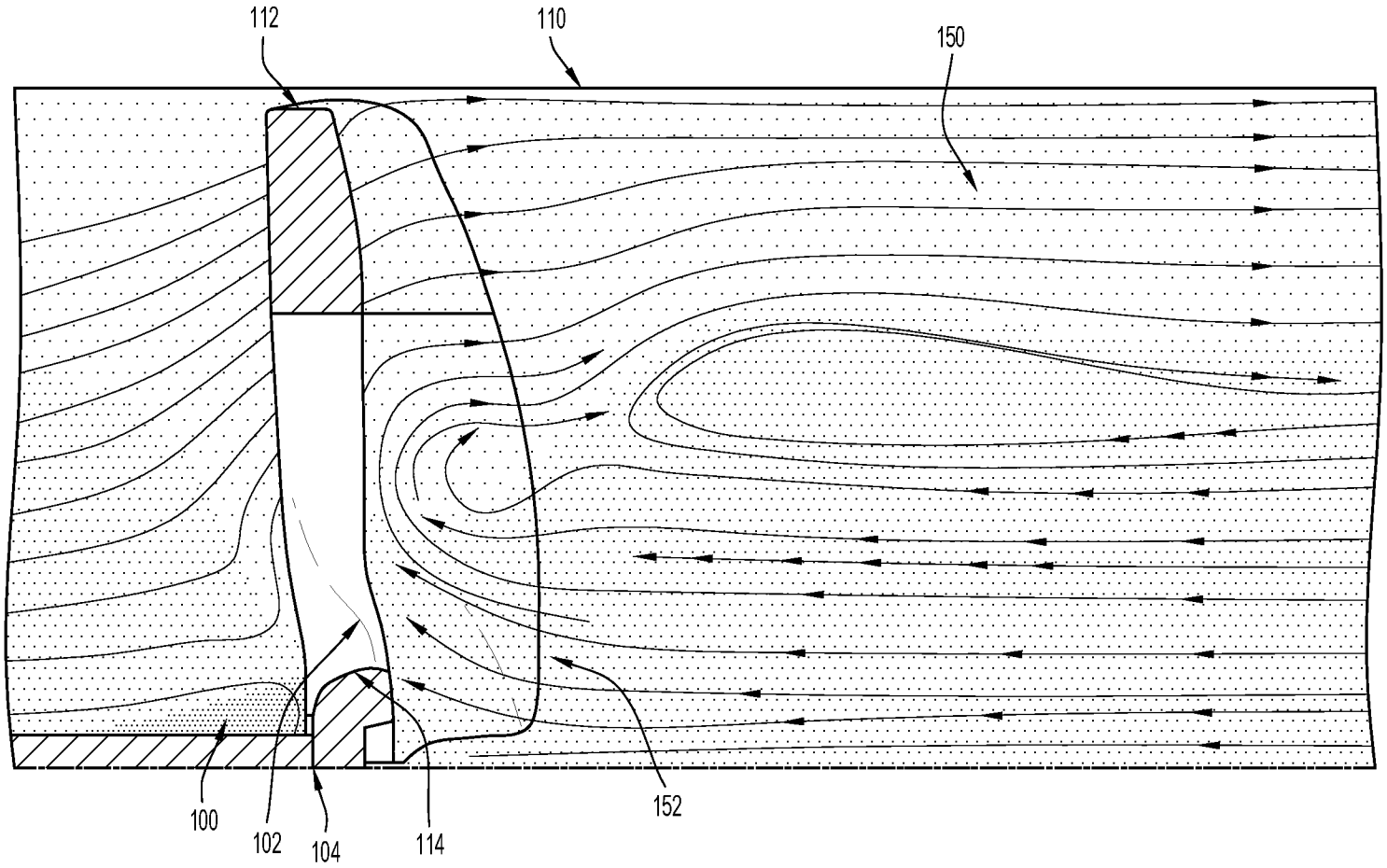
FIG. 1B is a partial side view of the axial fan assembly of FIG. 1A illustrated with fan flow characteristics.

Referring to FIGS. 1A and 1B, a conventional axial fan assembly is shown. The fan assembly includes an axial fan 100 having fan blades 102 arranged about and radially extending from a fan hub 104. The fan 100 is disposed inside a shroud 110 which extends circumferentially about the fan 100. As the fan 100 rotates, the blades 102 induce a flow 150 in a working fluid, e.g., air, gas, and/or liquid. As illustrated in the flow lines in FIG. 1A, a portion of the fan flow 150 from the fan 100 includes a circumferential component due to the rotation of the fan 100. As illustrated in FIG. 1B, the flow 150 moves faster at a tip 112 of the blade 102 than at a base 114 of the blade 102 near the fan hub 104. The circumferential component and difference in flow speed along the radius of the fan 100 causes pressure differentials between the tip 112 and the base 114. Due to the pressure differential, a portion of the fan flow 150 downstream of the fan hub 104 may flow back into the fan 100. This backflow 152 may choke or cause extra strain on the fan 100, which may result in the use of additional power to operate the fan 100 and may lower the fan's static efficiency. Additionally, little, if any, of the backflow 152 is converted to static pressure, thus, further reducing fan static efficiency.

Figure 2A:
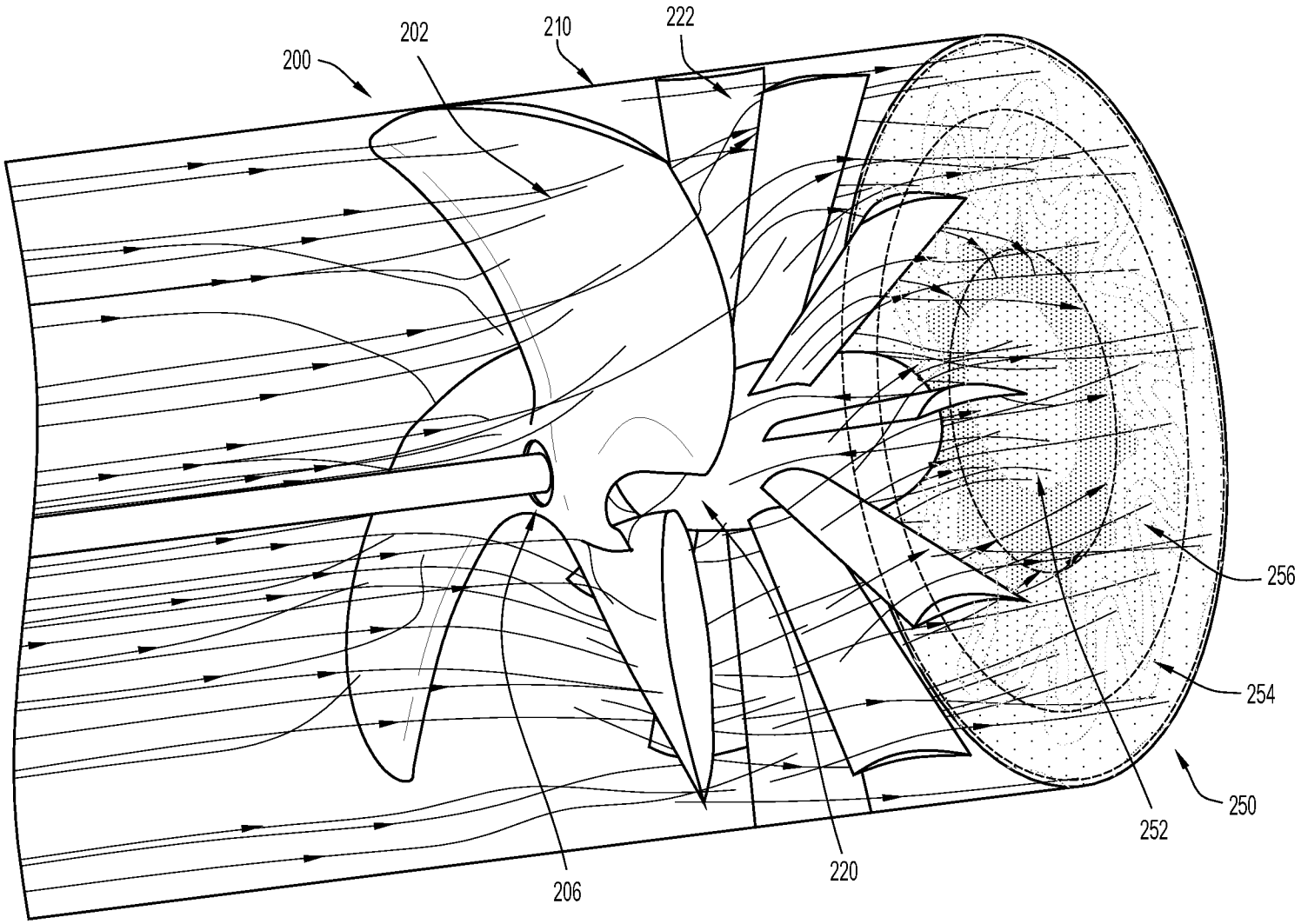
FIG. 2A is a perspective view of an axial fan assembly having an axial fan and guide vanes illustrated with fan flow characteristics.
Figure 2B:
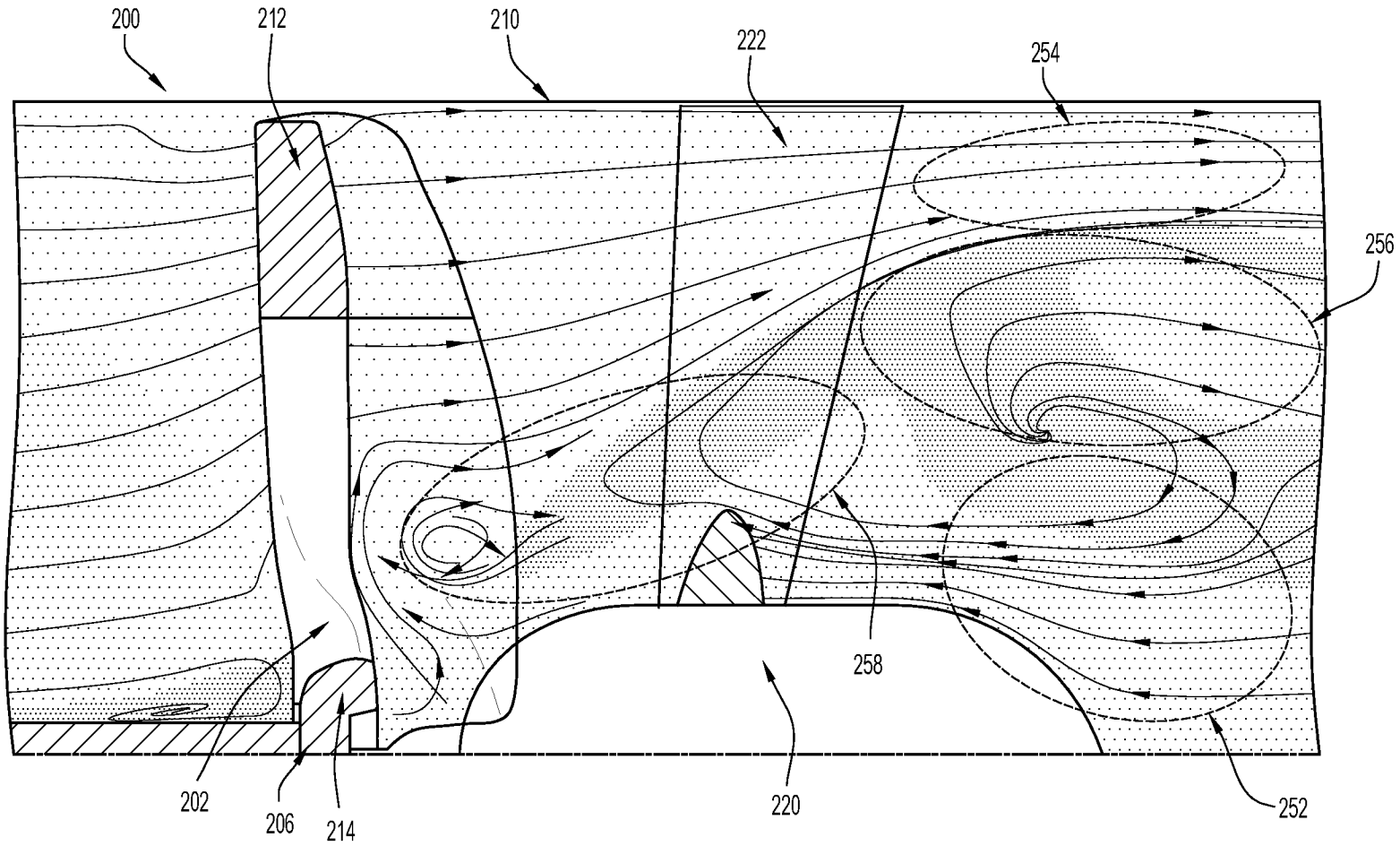
FIG. 2B is a partial side view of the axial fan assembly of FIG. 2A illustrated with fan flow characteristics.

Referring to FIGS. 2A and 2B, a conventional axial fan assembly equipped with a guide vane assembly is shown. The axial fan assembly includes an axial fan 200 having fan blades 202 arranged about and radially extending from a fan hub 206. The guide vane assembly includes vanes 222 disposed about and radially extending from a hub 220. Both the fan and guide vane assembly are disposed inside a shroud 210 which extends circumferentially about the fan 200 and guide vane assembly. As the fan 200 rotates, the blades 202 induce a flow 250 in a working fluid, e.g., air. A portion of the fan flow 250 from the fan 200 includes a circumferential component due to the rotation of the fan 200. As illustrated in the flow plot in FIGS. 2A and 2B, as the flow 250 passes through the guide vane assembly, the vanes 222 rectify the rotational component of the fan flow 250, thereby increasing the overall static pressure. The flow 250 moves faster at a tip 212 of the blade 202 than at a base 214 of the blade 202 near the fan hub 206. The difference in speeds is illustrated in FIG. 2A. In the radially outer most region 254 of the flow is a high-speed flow from the fan 200. The radially inner most region of the flow is a recirculation or hub dead water region 252. Between the recirculation region 252 and high-speed region 254 is low speed region 256.

The differences in flow speed along the radius of the fan 200 and/or along the radius of the shroud 210 (e.g., between the three regions 252, 254, 256) causes pressure differentials between the tip 212 and base 214 of the blade 202. As shown in FIG. 2B, due to the pressure differential and hub dead water, a portion 258 of the fan flow 250 downstream of the vane hub 220 may flow back into vane assembly and fan 200. This backflow 258 may choke the guide vane assembly and/or cause extra strain on the fan 200. This may result in the use of additional power to operate the fan 200 and, thus, lower the fan assembly's static efficiency. Additionally, little, if any, of the backflow 252 is converted to static pressure, thus, further reducing fan's static efficiency.

Referring to FIGS. 3A-3D, an axial fan assembly 300, according to an exemplary embodiment is shown. The fan assembly 300 includes a fan 301, guide vane assembly 320, and a shroud 310 which extends circumferentially about the fan 301 and guide vane assembly 320. The shroud 310 may have a uniform radius along its axial length. The fan 301 includes a fan hub 306 and at least one fan blade 302 radially extending from the fan hub 306. Each fan blade 302 may include a leading edge 304 and trailing edge 308 that radially extend from a blade base 316 disposed proximate to the fan hub 306 to a blade tip 312 disposed or located near the shroud 310. Rotation of the at least one blade 302 of the axial fan 301 about the hub 306 generates a flow 350 with a rotational component through the shroud 310.

The guide vane assembly 320 is disposed downstream of the fan 301 and includes a hub 321 and vanes 322 radially extending from the hub 321 to the shroud 310. The guide vanes 322 may have an aerodynamic shape for converting the rotating component of the fan flow 350 output from the fan 301 into static pressure. For example, each guide vane 322 may be an airfoil. The hub 321 includes an upstream portion 324 and a downstream portion 326. The upstream portion 324 is a portion of the hub 321 proximal to the fan 301, while the downstream portion 326 is a portion of the hub 321 distal to the fan 301. The downstream portion 326 may slope radially inwards. For example, the hub 321 may have a rounded downstream portion 326. The hub 321 further includes a recess 328 extending from an end of the downstream portion 326 into the hub 321 in a direction that is parallel with a central axis 370 of the axial fan assembly 300.

Figure 3B:
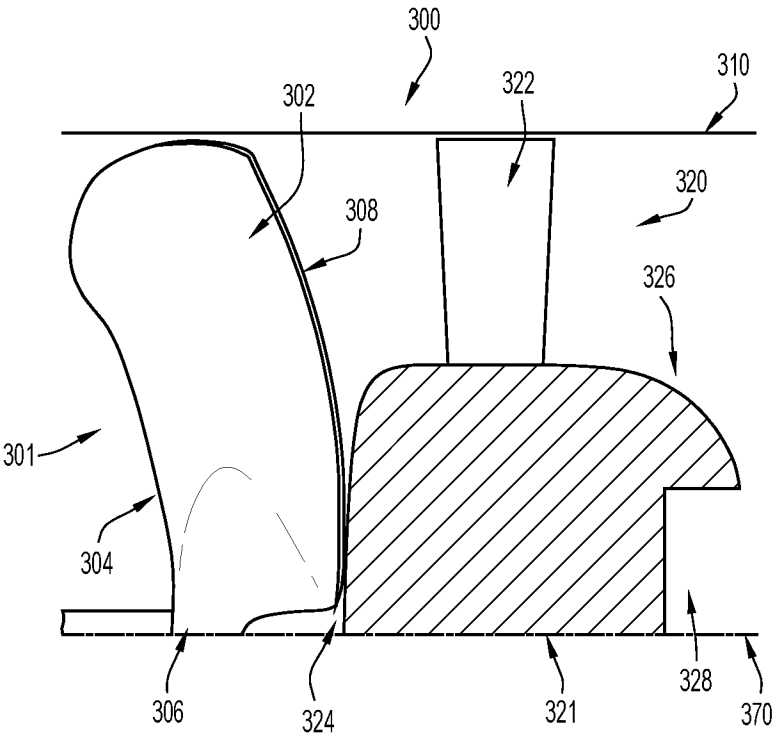
FIG. 3B is a partial side view of the axial fan assembly of FIG. 3A.
Figure 3A:
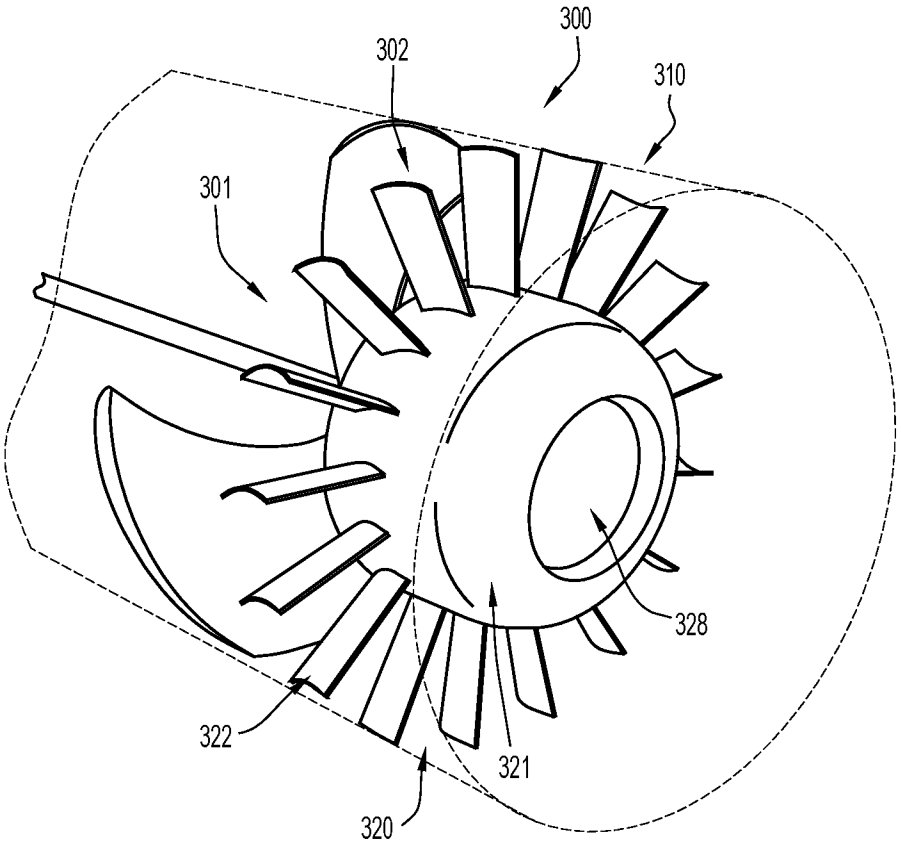
FIG. 3A is a perspective view of an axial fan assembly having an axial fan and hub assembly, according to an embodiment of the present invention.
Figure 3C:
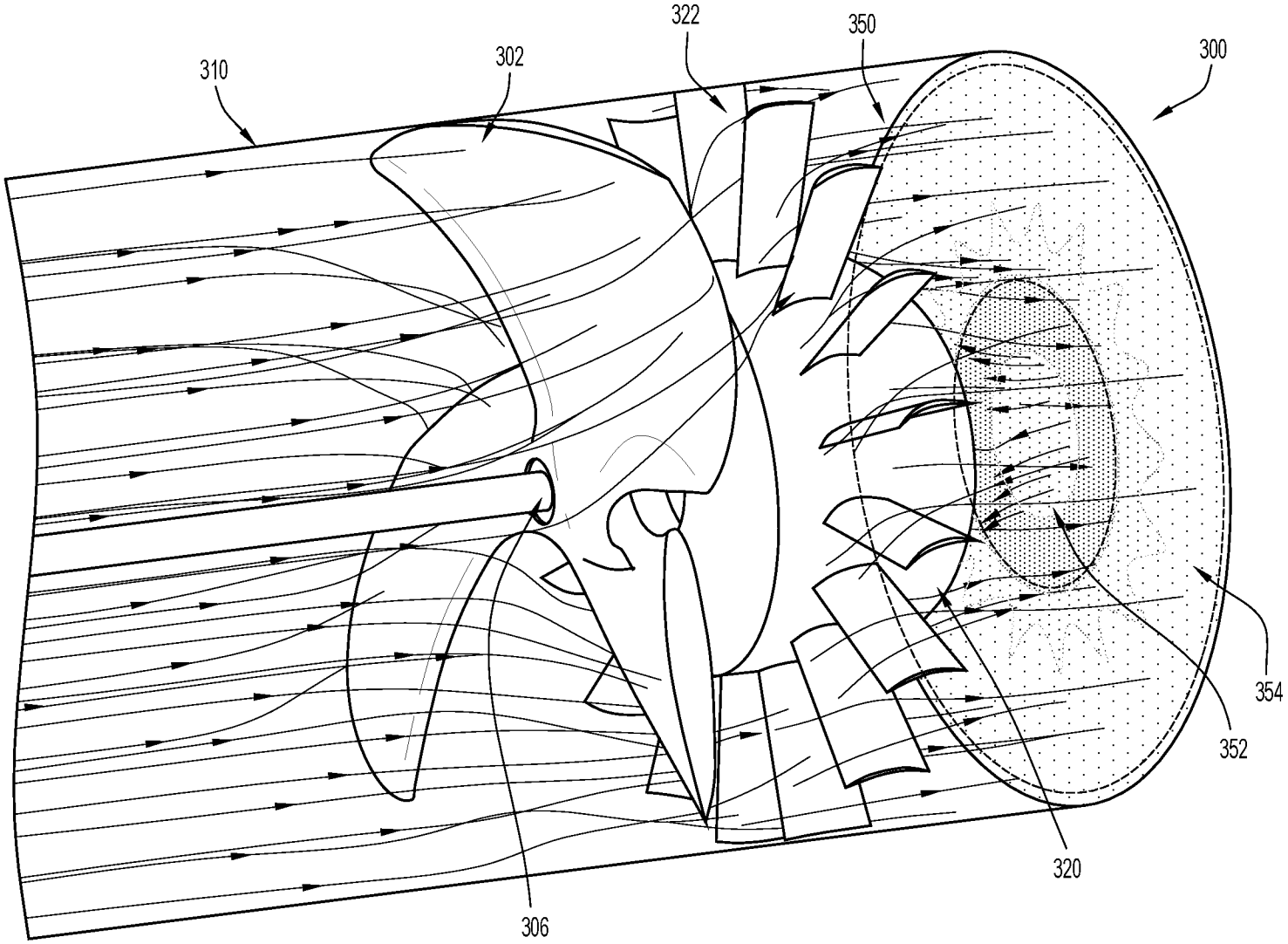
FIG. 3C is a perspective view of the axial fan assembly of FIG. 3A illustrated with fan flow characteristics.
Figure 3D:
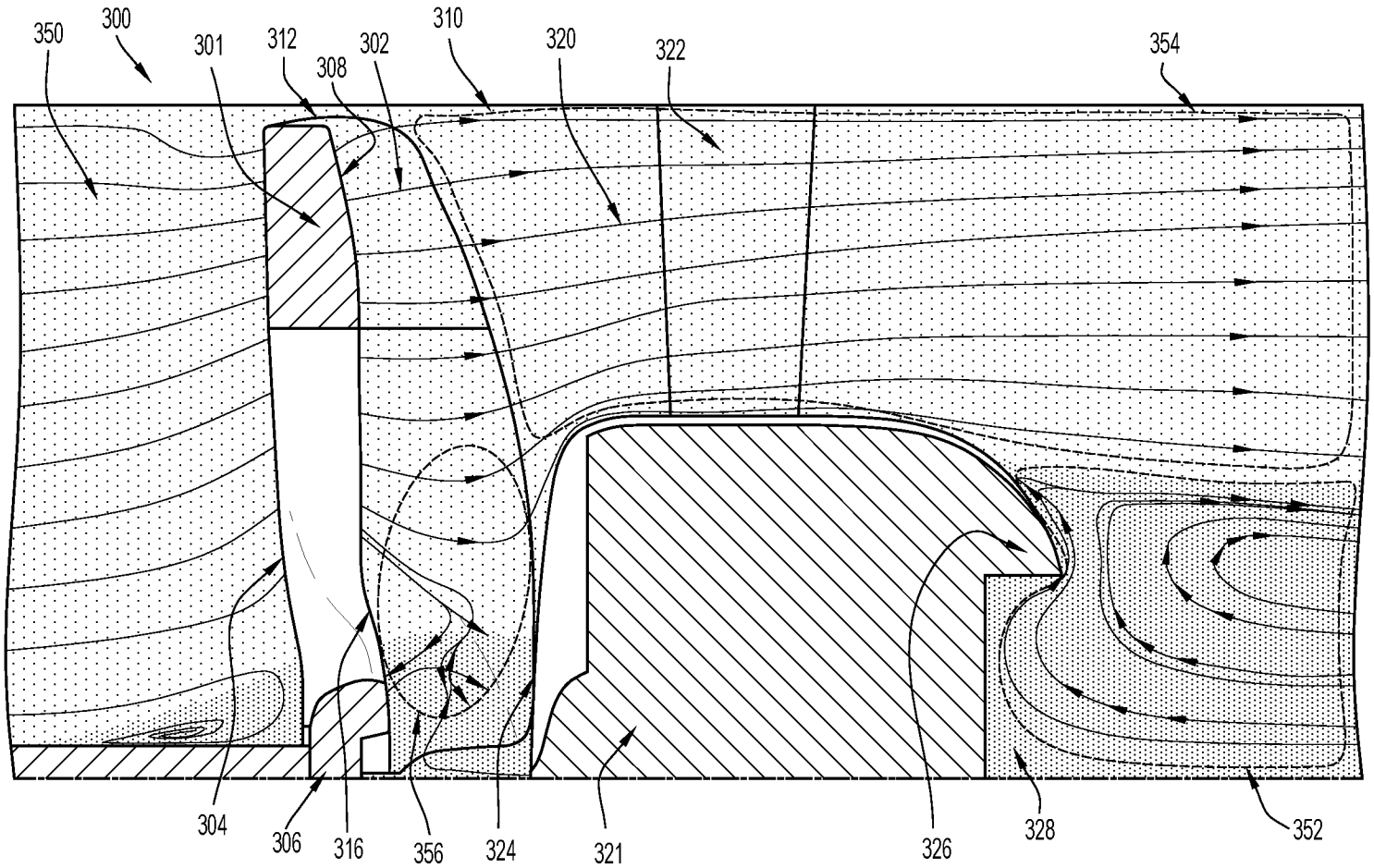
FIG. 3D is a partial side view of the axial fan assembly of FIG. 3A illustrated with fan flow characteristics.

Referring to FIGS. 3C and 3D, a flow plot of the fan flow 350 of the working fluid through the fan assembly 300 is shown. The hub 321 is arranged and sized to accelerate a first portion 356 of the fan flow 350 from the fan 301 near the blade base 315 radially along the upstream portion 324 towards an outer circumference of the hub 321 and the guide vanes 322. A second portion 354 of the fan flow 350, or outlet flow 354, passes through the vanes 322, where a section of the second portion 354 of the fan flow 350 follows a contour of the hub 321 to the downstream portion 326 and into the hub recess 328. A hub dead water or recirculation region 352 is generated downstream of the hub 321. The recirculation region 352 may have a lower total pressure than the total pressure of the second portion 354 of the fan flow 350. The recirculation region 352 pulls the second portion 354 of the fan flow 350 radially inward, thus diffusing the second portion 354 of the fan flow 350, e.g., converting the second portion 354 of the fan flow 350 velocity into static pressure. The recovery of static pressure from the second portion 354 of the fan flow 350 velocity improves static efficiency of the fan 301. In some implementations, the second portion 354 of the fan flow 350 comprises a uniform or unidirectional flow.

As shown in FIGS. 3B and 3D, the hub 321 is coaxial with the fan 301 and overlaps a portion of the fan blades 302. The hub 321 is sized and arranged with respect to the fan 301 to cause the first portion 356 of the fan flow 350 coming from the blade base 316 to accelerate along the hub 321 and generate a recirculation region 352 downstream of the hub 321. The accelerated first portion 356 of the fan flow 350 provides a substantially uniform velocity for the second portion 354 of the fan flow 350 through the guide vane assembly 320. The recirculation region 352 draws the second portion 354 of the fan flow 350 radially inward downstream of the hub 321. Thus, a substantially uniform velocity diffused outlet flow 354 exits the shroud 310 of the fan assembly 300. For example, a radius of the hub 321 may be about one-quarter (¼) to one-half (½) of a radius of the fan 301. That is, the radius of the hub 321 may range from about one-quarter (¼) to one-half (½) of the radius of the fan 301. In some implementations, the radius of the hub 321 is about one-quarter (¼) of the radius of the fan 301; one-third (⅓) of the radius of the fan 301; or one-half (½) of the radius of the fan 301. The hub 321 may be arranged at a distance from a leading edge 304 of the fan 301. For example, the distance may be about one-tenth (1/10) to three-fifths (⅗) of the radius of the fan blade 302. That is, the distance may range from about one-tenth (1/10) to three-fifths (⅗) of the radius of the fan blade 302. In some implementations the distance may be one-tenth (1/10) of the radius of the fan blade 302; one-fifth (⅕) of the radius of the fan blade 302; one-fourth (¼) of the radius of the fan blade 302; three-tenths (3/10) of the radius of the fan blade 302; two-fifths (⅖) of the radius of the fan blade 302; one-half (½) of the radius of the fan blade 302; or three-fifths (⅗) of the radius of the fan blade 302. However, embodiments are not limited to the arrangements described above. For example, the hub 321 may not overlap fan blades 302 and the hub 321 radius and distance from the leading edge 304 of the fan blade 302 may be set at any amount sufficient to generate the substantially uniform velocity diffused outlet flow 354 noted above.

The recess 328 may be sized within the hub 321 to further generate the recirculation region 352 downstream of the hub 321 to pull down and diffuse the second portion 354 of the fan flow 350. For example, a radius of the recess 328 may be about 60% to 80% of the radius of the hub 321 and axially extend 5% to 20% into the hub 321 from downstream portion 326. That is, the radius of the recess 328 may range from about 60% to 80% of the radius of the hub 321 and an axial depth of the recess 328 may range from about 5% to 20% of an axial length of the hub 321. In some implementations, the radius of the recess 328 is about 80% of the radius of the hub 321; 75% of the radius of the hub 321; 70% of the radius of the hub 321; 65% of the radius of the hub 321; or 60% of the radius of the hub 321. In some implementations, the recess 328 may axially extend into about 5%, 10%, 15%, or 20% of the hub 321 from the downstream portion 326 (e.g., 5%, 10%, 15%, or 20% of the axial length of the hub 321). However, embodiments are not limited thereto and the recess 328 radius and axial depth may be set at any value sufficient to generate the substantially uniform velocity diffused outlet flow 354 noted above.

Referring to FIGS. 4A-4D, an axial fan assembly 400, according to an exemplary embodiment is shown. The fan assembly 400 includes a fan 401, guide vane assembly 420, and a shroud 410 which extends circumferentially about the fan 401 and guide vane assembly 420. The shroud 410 may have a uniform radius along its axial length. The fan 401 includes a fan hub 406 and at least one fan blade 402 radially extending from the fan hub 406. Each fan blade 402 may include a leading edge 404 and trailing edge 408 that radially extend from a blade base 414 disposed proximate to the fan hub 406 to a blade tip 412 disposed or located near the shroud 410. Rotation of the at least one blade 402 of the axial fan 401 about the fan hub 406 generates a fan flow 450 with a rotational component through the shroud 410.

The guide vane assembly 420 is disposed downstream of the fan 401 and includes a hub 421 and vanes 422 radially extending from the hub 421 to the shroud 410. The guide vanes 422 may have an aerodynamic shape for converting the rotating component of the flow 450 coming from the fan 401 into static pressure. For example, each guide vane 422 may be an airfoil. The hub 421 includes an upstream portion 424 and a downstream portion 426. The upstream portion 424 is a portion of the hub 421 proximal to the fan 401, while the downstream portion 426 is a portion of the hub 421 distal to the fan 401. The downstream portion 426 may slope radially inwards. For example, the hub 421 may have a rounded downstream portion 426. The hub 421 further includes a recess 428 extending from an end of the downstream portion 426 into the hub 421 in a direction that is parallel with a center axis 470 of the axial fan assembly 400.

The hub 421 further includes a recirculation channel 430 for recirculating a portion 460 of the flow 450 from the downstream portion 426 to the upstream portion 424 of the hub 424. The recirculation channel 430 extends from a channel inlet 432 disposed at the recess 428 to a channel outlet 434 disposed at the upstream portion 424. For example, the channel inlet 432 may be disposed in a radial sidewall of the hub 421 defining the recess 428. In some implementations, the channel inlet 432 may be an opening in the side wall of hub 421, the opening extends circumferentially about the recess 428. In some implementations, the channel inlet 432 may be a plurality of openings in the radial sidewall of the hub 421 disposed circumferentially about the recess 428. The channel outlet 434 may be disposed at the upstream portion 424, near the center of the hub 421, e.g., near the center axis 470. The recirculation channel 430 is configured to receive the recirculation flow 460 at the channel inlet 432, guide the recirculation flow 460 through the channel 430 to the channel outlet 434. The channel outlet 434 is configured to discharge the recirculation flow toward the blade base 414. In some implementations, the channel outlet 434 may be an opening extending axially through upstream portion 424 of the hub 421 near or along the center axis 470. In some implementations, the channel outlet 434 may be a plurality of openings extending axially through upstream portion 424 of the hub 421, the plurality of opening may be radially arranged about the center axis 470.

In some implementations, the recirculation channel 430 may swirl the recirculation flow 460 in the direction of rotation of the fan 401. For example, at least one of the recirculation channel 430, the channel inlet 432, and the channel outlet 434 may angle the recirculation flow 460 in the direction of rotation of the fan 401. In some implementations, at least one of the recirculation channel 430, the channel inlet 432, and the channel outlet 434 are angled in the direction of rotation of the fan 401 with respect to the center axis 470. In some implementations, at least one of the recirculation channel 430, the channel inlet 432, and the channel outlet 434 include one or more fins or vanes configured to guide the recirculation flow 460 in the direction of rotation of the fan 401. For example, the channel outlet 434 may include one or more vanes configured to direct the recirculation flow 460 toward the fan 401 and in a direction of rotation of the fan 401. In some implementations, the channel outlet 434 may include a plurality of openings radially arranged about the center axis 470. The plurality of openings may be configured to discharge the recirculation flow 460 towards and in a direction of rotation of the fan 401. That is, the plurality of openings of the channel outlet 434 may be angled towards and in a direction of rotation of the fan 401.

Figure 4B:
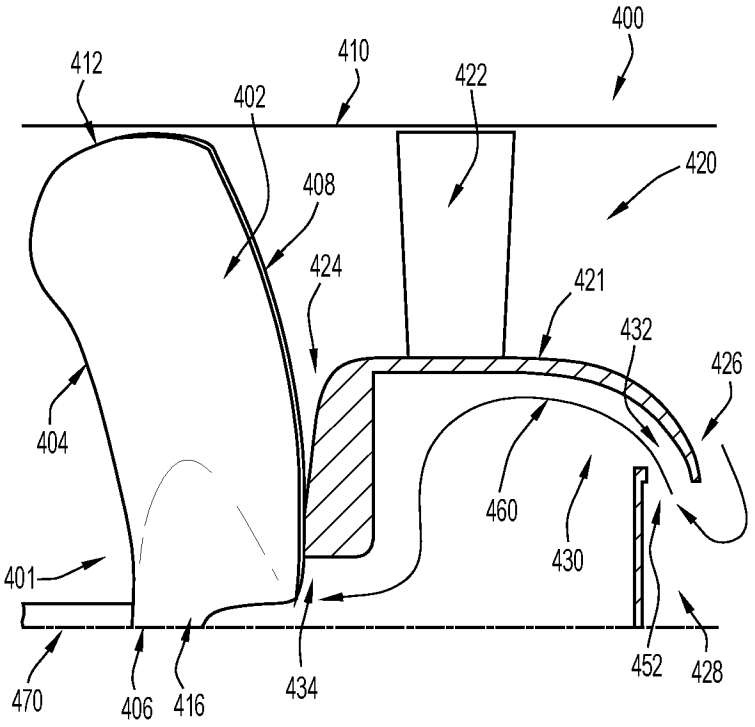
FIG. 4B is a partial side view of the axial fan assembly of FIG. 4A.
Figure 4A:
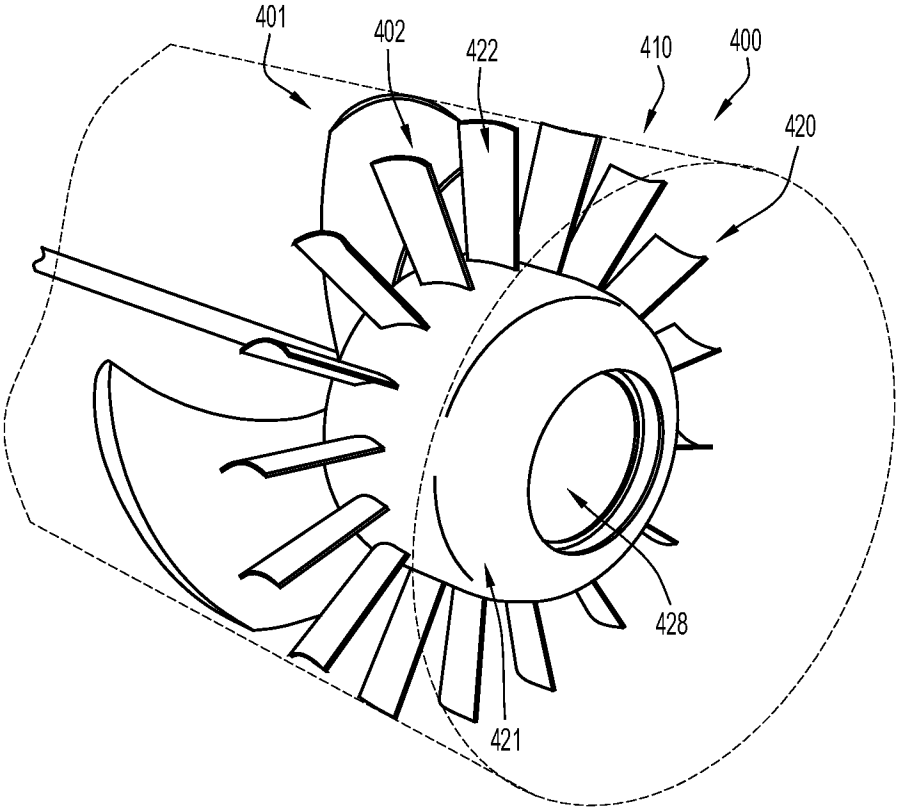
FIG. 4A is a perspective view of an axial fan assembly having an axial fan and hub assembly, according to another embodiment of the present invention.
Figure 4C:
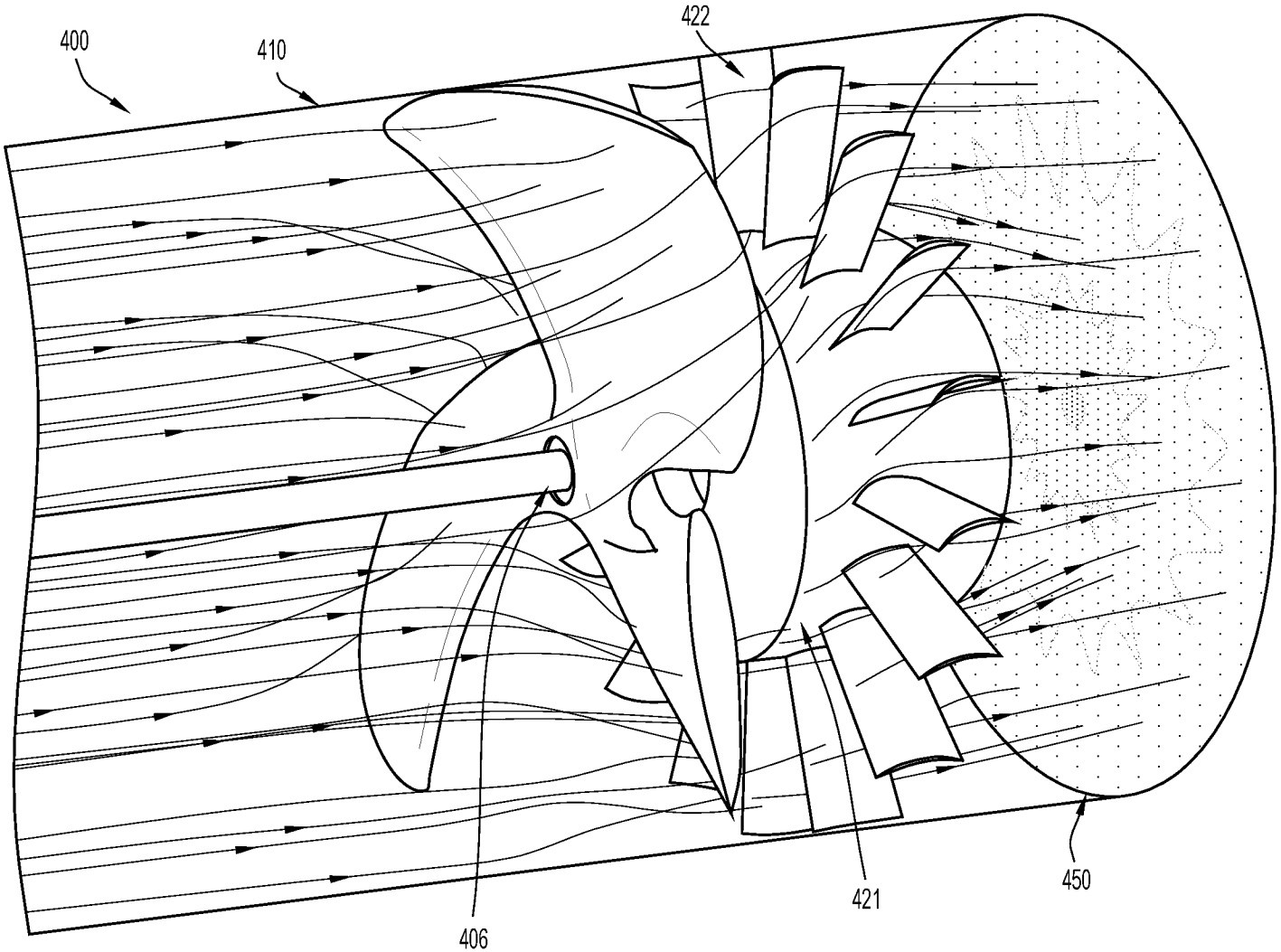
FIG. 4C is a perspective view of the axial fan assembly of FIG. 4A illustrated with fan flow characteristics.
Figure 4D:
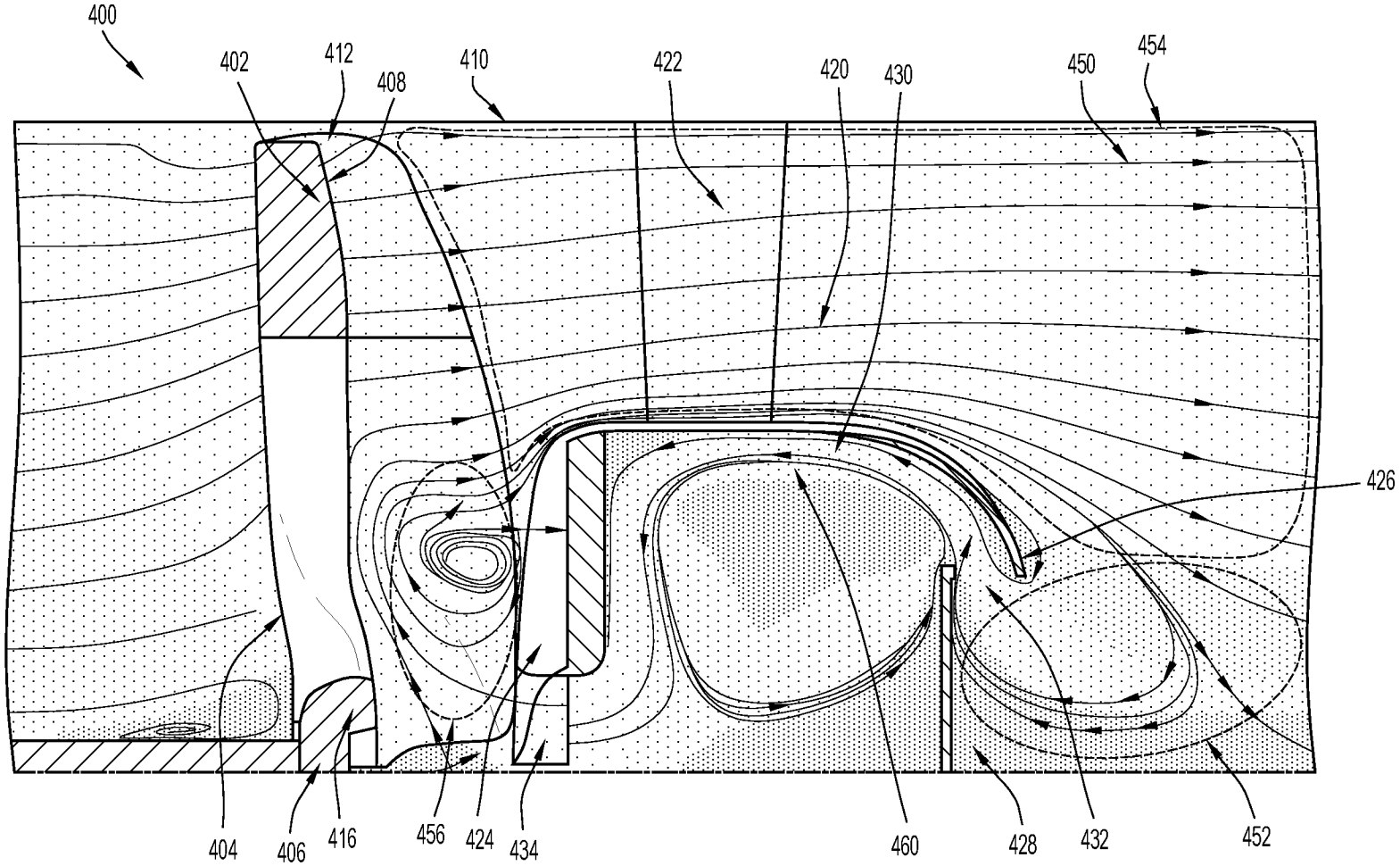
FIG. 4D is a partial side view of the axial fan assembly of FIG. 4A illustrated with fan flow characteristics.

Referring to FIGS. 4C-4D, a flow plot of the fan flow 450 of the working fluid through the fan assembly 400 is shown. The hub 421 is arranged and sized to accelerate a first portion 456 of the fan flow 450 from the fan 401 near the blade base 416 radially along the upstream portion 424 towards an outer circumference of the hub 421 and the guide vanes 422. An outlet flow 454, or second portion 454 of the fan flow 450, passes through the vanes 422, where a segment of the second portion 454 of the outlet flow 450 follows the contour of the hub 421 to the downstream portion 426 and into the hub recess 428. A hub dead water or recirculation region 452 is generated downstream of the hub 421. The recirculation region 452 may have a lower total pressure than the total pressure of the outlet flow 454. The recirculation region 452 pulls the outlet flow 454 radially inward, thus diffusing the outlet flow 454, e.g., converting the second portion 454 of the fan flow 450 velocity into static pressure. The recovery of static pressure from flow 454 velocity provides high static efficiency of the fan 401. For example, the static efficiency of the fan 401 may range from 55% to 68%. In some implementations, the static efficiency of the fan 401 is about 66% at a flow rate of about 20 $m^3/s$.

As shown in FIGS. 4B and 4D, the hub 421 is coaxial with the fan 401 and overlaps a portion of the fan blades 402. The hub 421 is sized and arranged with respect to the fan 401 to cause the first portion 456 of the fan flow 450 from the blade base 416 to accelerate along the hub 421 and generate a recirculation region 452 downstream of the hub 421. Thus, a substantially uniform, diffused flow 454 exits the shroud 410 of the fan assembly 400. For example, a radius of the hub 421 may be about one-quarter (¼) to one-half (½) of a radius of the fan 401. That is, the radius of the hub 421 may range from about one-quarter (¼) to one-half (½) of the radius of the fan 401. In some implementations, the radius of the hub 421 is about one-quarter (¼) of the radius of the fan 401; one-third (⅓) of the radius of the fan 401; or one-half (½) of the radius of the fan 401. The hub 421 may be arranged at a distance from a leading edge 404 of the fan 401. For example, the distance may be about one-tenth (1/10) to three-fifths (⅗) of the radius of the fan blade 402. That is, the distance may range from about one-tenth (1/10) to three-fifths (⅗) of the radius of the fan blade 402. In some implementations the distance may be one-tenth (1/10) of the radius of the fan blade 402; one-fifth (⅕) of the radius of the fan blade 402; one-fourth (¼) of the radius of the fan blade 302; three-tenths (3/10) of the radius of the fan blade 402; two-fifths (⅖) of the radius of the fan blade 402; one-half (½) of the radius of the fan blade 402; or three-fifths (⅗) of the radius of the fan blade 402. However, embodiments are not limited thereto and the hub 421 radius and distance from the leading edge 404 of the fan blade 402 may be set at any amount sufficient to generate the substantially uniform velocity diffused outlet flow 454 noted above.

The recirculation channel 430 may provide recirculation region 452 with a lower total pressure as compared to recirculation region 152, 252, and 352 of fan assemblies 100, 200, and 300, respectively, and shown in FIGS. 1A-3D. Thus, the fan assembly 400 may provide greater diffusion of the fan flow 450 as compared with the fan flows 150, 250, and 350 of fan assemblies 100, 200, and 300, respectively, discussed above. Accordingly, the fan assembly 400 may operate at a higher static efficiency as compared to fan assemblies 100, 200, and 300.

Figure 5A:
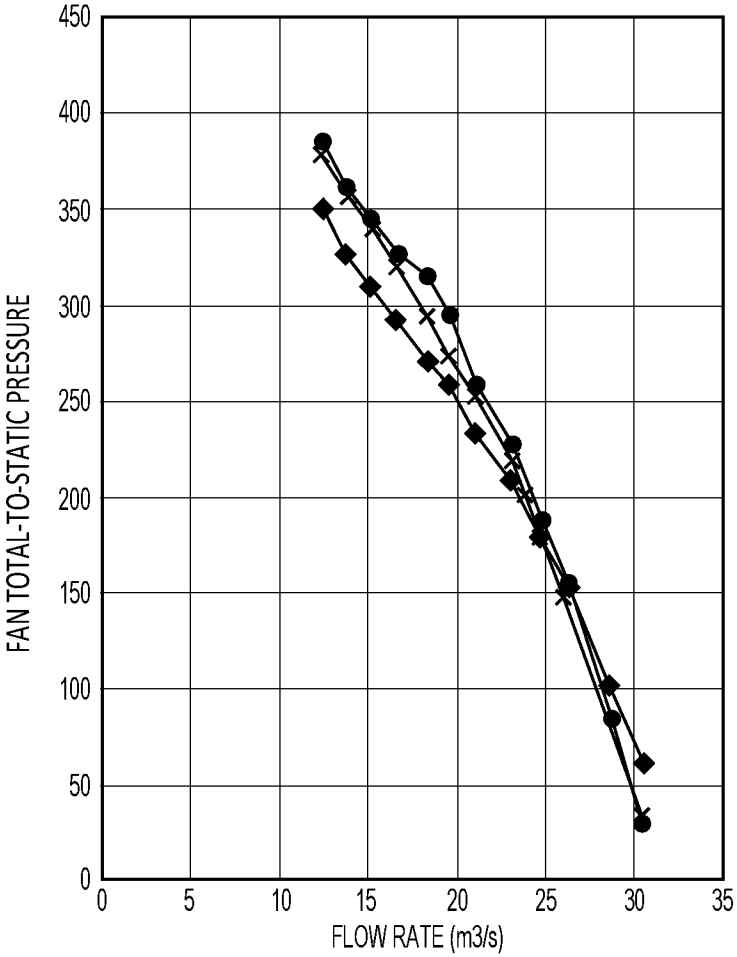
FIG. 5A is a graph comparing the fan total-to-static pressure of a fan assemblies' outlet flow vs. flow rate for the fan assemblies of FIGS. 2A, 3A, and 4A.
Figure 5B:
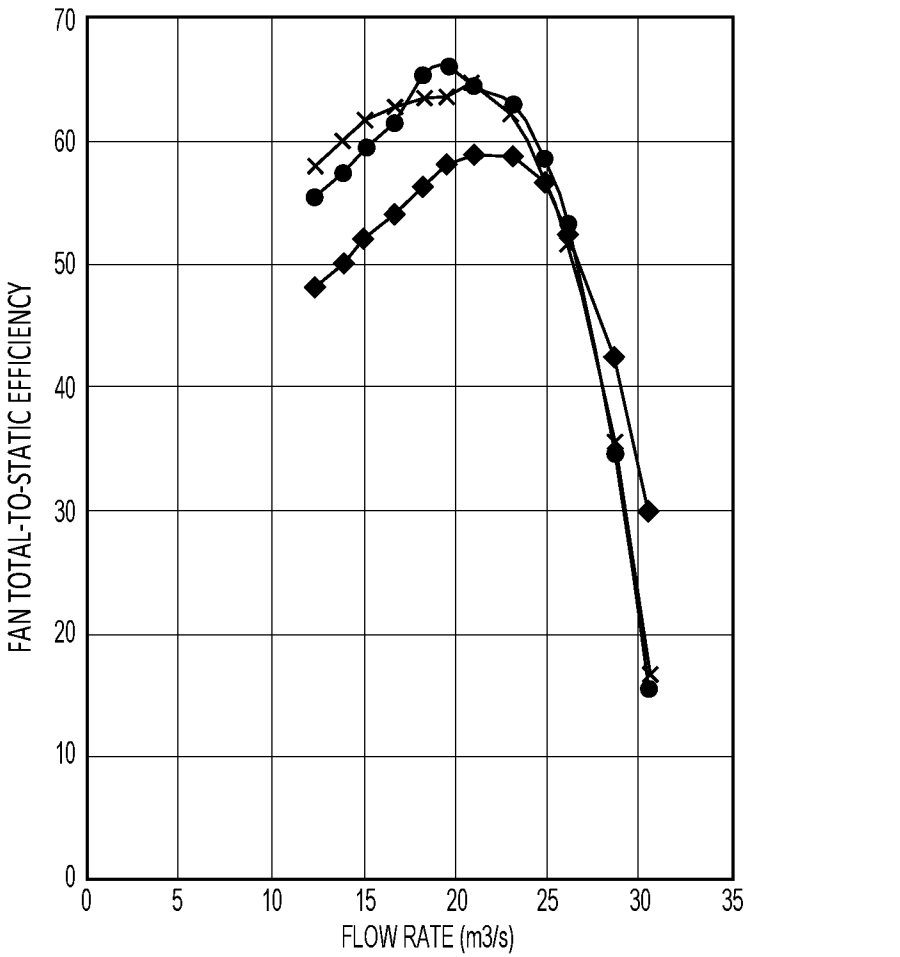
FIG. 5B is a graph comparing the total-to-static efficiency of a fan assemblies' outlet flow vs. flow rate for the fan assemblies of FIGS. 2A, 3A, and 4A.

Referring to FIGS. 5A and 5B, two graphs are shown, where one graph (FIG. 5A) compares a fan's total-to-static pressure vs. flow rate for the fan assembly 200, fan assembly 300 and fan assembly 400, and the other graph (FIG. 5B) compares a fan's static efficiency vs. flow rate for the fan assembly 200, fan assembly 300 and fan assembly 400. In FIG. 5A, the fan total-to-static pressure in Pascals (Y-axis) is plotted against flow rate (X-axis) for each one of fan assembly 200, fan assembly 300, and fan assembly 400. As shown in the graph, fan assembly 300 has a higher fan total-to-static pressure over a large range of flow rates, e.g. about 12 $m^3/s$ to about 26 $m^3/s$, as compared to fan assembly 200. Fan assembly 400 has a higher fan total-to-static pressure as compared to both fan assembly 200 and fan assembly 300 over substantially the same range of flow rates.

In FIG. 5B, the fan total-to-static efficiency as a percentage (Y-axis) is plotted against flow rate (X-axis) for each one of fan assembly 200, fan assembly 300, and fan assembly 400. As shown in the graph, fan assembly 300 has a higher fan total-to-static efficiency over a large range of flow rates, e.g. about 12 $m^3/s$ to about 26 $m^3/s$, as compared to fan assembly 200. Fan assembly 400 has a higher fan total-to-static efficiency as compared to fan assembly 200 over substantially the same range of flow rates and an improved efficiency as compared to fan assembly 300 over a range of about 17 $m^3/s$ to about 22 $m^3/s$.

While the graphs in FIGS. 5A and 5B provide example total-to-static efficiencies and total-to-static pressures over a specific range of flow rates, embodiments are not limited to the specific total-to-static efficiencies, total-to-static pressures, and/or flow rates disclosed. Rather, the flow rates for achieving desired static efficiencies and static pressures may be adjusted by adjusting the size of the fan assembly. For example, a radius of the fan assembly, e.g., fan 401 and vane hub assembly 420 may be adjusted to provide a desired efficiency at a desired flow rate.

Figure 6:
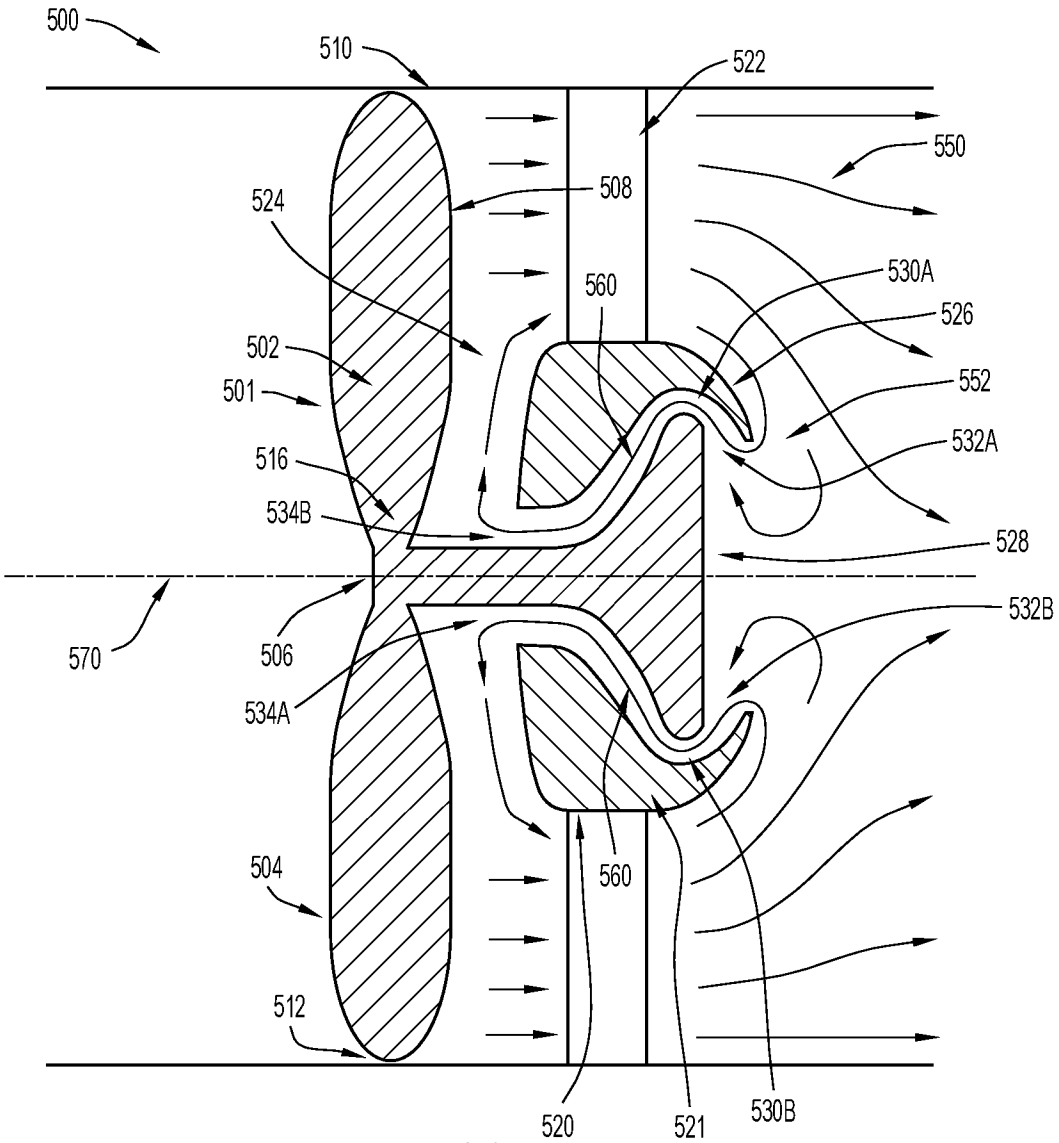
FIG. 6 is a partial cross-sectional view of an axial fan assembly having an axial fan and a hub assembly, according to a third embodiment of the present invention.

Referring to FIG. 6, an axial fan assembly 500, according to an exemplary embodiment is shown. The fan assembly 500 includes a fan 501, a hub assembly 520, and a shroud 510 which extends circumferentially about the fan 501 and hub assembly 520. The shroud 510 may have a substantially uniform radius along its axial length. The fan 501 includes a fan rotor 506 extending from the hub assembly 520 and at least one fan blade 502 radially extending from the fan rotor 506. The fan blade 502 includes a leading edge 504 and trailing edge 508 that radially extend from a blade base 514 at the fan rotor 506 to a blade tip 512 near the shroud 510. Rotation of the at least one blade 502 of the axial fan 501 generates a fan flow 550 with a rotational component through the shroud 510. The components of the fan assembly 500 may be arranged, sized, and shaped substantially similar to the components of fan assembly 400 to provide substantially similar flow characteristics as fan assembly 400 depicted in FIGS. 4C-5B.

The hub assembly 520 is disposed downstream of the fan 501 and includes a hub 521 and at least one strut 522 radially extending from the hub 521 to the shroud 510 for supporting the hub 521 and fan 501. In some implementations, the strut 522 may be a guide vane having an aerodynamic shape for converting the rotating component of the flow 550 into static pressure. For example, the guide vane 522 may be an airfoil. The hub 521 includes an upstream portion 524 and a downstream portion 526. The upstream portion 524 is a portion of the hub 521 axially proximal to the fan 501, while the downstream portion 526 is a portion of the hub 521 axially distal to the fan 501. The downstream portion 526 may slope radially inwards. For example, the hub 521 may have a rounded downstream portion 526. The hub 521 further includes a recess 528 extending from an end of the downstream portion 526 and extends into the hub 521 parallel with a center axis 570 of the axial fan assembly 500.

The hub 521 further includes at least a first recirculation channel 530A and a second recirculation channel 530B for recirculating a portion 560 of the flow 550 from the downstream portion 526 to the upstream portion 524 of the hub 524. The recirculation channels 530A, 530B extend from a first channel inlet 532A and a second channel inlet 532B, respectively, disposed at the recess 528 to a first channel outlet 534A and a second channel outlet 534B, respectively, disposed at the upstream portion 524. For example, the channel inlets 532A, 532B, may be disposed in a radial sidewall of the hub 521 defining the recess 528. In some implementations, the channel inlets 532A, 532B may be openings in the side wall of hub 521. In some implementations, more than two the channel inlets 532A, 532B may be included. For example, a plurality of openings in the radial sidewall of the hub 521 disposed radially about the recess 528. The channel outlets 534A, 534B may be disposed at the upstream portion 524, near the center of the hub 521, e.g., near the center axis 570. The recirculation channels 530A, 530B is configured to receive the recirculation flow 560 at the channel inlets 532A, 532B, guide the recirculation flow 560 through the channels 530A, 530B to the channel outlets 534A, 534B. The channel outlets 534A, 534B are configured to discharge the recirculation flow 560 toward the blade base 516. In some implementations, the channel outlets 534A, 534B may be openings extending axially through upstream portion 524 of the hub 521 near or along the center axis 570. In some implementations, the hub 521 may include more than two channel outlets 534A, 534B. For example, the hub 521 may include a plurality of openings extending axially through upstream portion 524 of the hub 521, the plurality of opening may be radially arranged about the center axis 570.

In some implementations, the recirculation channels 530A, 530B may swirl the recirculation flow 560 in the direction of rotation of the fan 501. For example, at least one of the recirculation channels 530A, 530B; the channel inlets 532A, 532B; and the channel outlets 534A, 534B may angle the recirculation flow 560 in the direction of rotation of the fan 501. In some implementations, at least one of the recirculation channels 530A, 530B; the channel inlets 532A, 532B; and the channel outlets 534A, 534B are angled in the direction of rotation of the fan 501 with respect to the center axis 570. In some implementations, at least one of the recirculation channels 530A, 530B; the channel inlets 532A, 532B; and the channel outlets 534A, 534B include one or more fins or vanes configured to guide the flow 560 in the direction of rotation of the fan 501. For example, each of the channel outlets 534A, 534B may include one or more vanes configured to direct the recirculation flow 560 toward the fan 501 and in a direction of rotation of the fan 501. In some implementations, the channel outlets 534A, 534B may include a plurality of openings radially arranged about the center axis 570. The plurality of openings may be configured to discharge the recirculation flow 560 towards and in a direction of rotation of the fan 501. That is, the plurality of openings of the channel outlets 534A, 534B may be angled towards and in a direction of rotation of the fan 501. As shown in FIG. 6, the recirculation channels 530A, 530B may have a variable cross section for facilitating the flow 560 through the channels 530A, 530B. The channels 530A, 530B may define serpentine path through the hub 521. For example, the serpentine path may be defined by an "S" shaped channel disposed parallel to the centerline 570.

In some implementations, the hub 521 may be configured to house a fan motor (not shown). The fan motor may be configured to drive the fan 501 via the fan rotor 506. An outer radial surface of the fan motor and/or fan rotor 506 may define a portion of the recirculation channels 530A, 530B. The recirculation flow 560 may directly contact and provide a cooling flow to an outer surface of the motor and or fan rotor 506.

While three fan blades 302, 402, are shown in FIGS. 3A-4D, and two fan blades are shown in FIG. 6, embodiments are not limited thereto. The fans 301, 401, 501 may have any number of fan blades 302, 402, 502, respectively. For example, the fans 301, 401, 501 may include 2, 3, 4, 5, 6, 7, 8, 9, or 10 fan blades.

While the invention has been illustrated and described in detail and with reference to specific embodiments thereof, it is nevertheless not intended to be limited to the details shown, since it will be apparent that various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

It is also to be understood that the fan assemblies described herein, or portions thereof may be fabricated from any suitable material or combination of materials, such as plastic, foamed plastic, wood, cardboard, pressed paper, metal, supple natural or synthetic materials including, but not limited to, cotton, elastomers, polyester, plastic, rubber, derivatives thereof, and combinations thereof. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, ethylene-vinyl acetate (EVA), or the like. Suitable foamed plastics may include expanded or extruded polystyrene, expanded or extruded polypropylene, EVA foam, derivatives thereof, and combinations thereof.

Finally, it is intended that the present invention cover the modifications and variations of this invention that come within the scope of the appended claims and their equivalents. For example, it is to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Similarly, when used herein, the term "comprises" and its derivations (such as "comprising", etc.) should not be understood in an excluding sense, that is, these terms should not be interpreted as excluding the possibility that what is described and defined may include further elements, steps, etc. Meanwhile, when used herein, the term "approximately" and terms of its family (such as "approximate", etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about" and "around" and "substantially".

The invention claimed is:

1. An assembly comprising:

a shroud having a substantially uniform radius along an axial length;

a hub disposed within the shroud, the hub comprising:

an upstream portion, and a downstream portion having a recess extending axially into the hub, the downstream portion being configured to diffuse a flow of fluid downstream of the hub; and vanes radially extending between the hub and the shroud.

2. The assembly of claim 1, further comprising:

an axial fan having an axis of rotation aligned a center axis of the hub.

3. The assembly of claim 2, wherein the axial fan is disposed upstream from the hub; and the hub is arranged and sized to accelerate the flow of fluid radially towards an outer circumference of the hub.

4. The assembly of claim 2, wherein an axial distance between a leading edge of the axial fan and upstream end of the hub is in the range from 10 to 60% a radius of the axial fan.

5. The assembly of claim 2, wherein a radius of the hub is 45% of a radius of the axial fan.

6. The assembly of claim 2, wherein the hub further comprises a recirculation channel having a channel inlet at the recess and a channel outlet at the upstream portion of the hub, the recirculation channel configured to guide a recirculation flow from the channel inlet, through the hub, to the channel outlet, the channel outlet being configured to direct the recirculation flow towards the center axis of the axial fan.

7. The assembly of claim 6, wherein the channel outlet is further configured to swirl the recirculation flow in a direction of rotation of the axial fan.

8. The assembly of claim 1, wherein, during operation, a portion of the flow of fluid passes through the vanes, follows a contour of the hub, and flows into the recess of the hub.

9. A method of diffusing a flow of fluid comprising:

inducing a flow of fluid via an axial fan;

directing the flow toward a hub having guide vanes;

accelerating a first portion of the flow along an upstream end of the hub and towards the guide vanes;

rectifying the flow via the guide vanes; and after rectifying the flow via the guide vanes, guiding a second portion of the flow of fluid towards a recess in a downstream portion of the hub, wherein guiding the second portion of the flow diffuses a third portion of the flow radially inward.

10. The method of claim 9, wherein the second portion of the flow is a recirculation flow, the method further comprising:

guiding the recirculation flow from the recess through the hub via a recirculation channel; and ejecting the recirculation flow from the recirculation channel towards the axial fan.

11. The method of claim 10, further comprising swirling the recirculation flow in a direction of rotation of the axial fan.

12. The method of claim 11, wherein swirling the recirculation flow comprises directing the recirculation flow via a vane.

13. The method of claim 11, wherein swirling the recirculation flow comprises directing the recirculation flow via a plurality of channel outlets of the recirculation channel, the plurality of channel outlets being angled towards a direction of rotation of the axial fan.

14. The method of claim 9, wherein guiding a recirculation flow of the flow of fluid towards a recess in a downstream portion of the hub maintains a laminar flow through the guide vanes.

15. An assembly comprising:

a shroud;

a hub disposed within the shroud, the hub comprising:

an upstream portion, a downstream portion having a recess extending axially into the hub, and a recirculation channel extending from the recess to the upstream portion, the recirculation channel being configured to diffuse a flow of fluid downstream of the hub; and vanes radially extending between the hub and the shroud.

16. The assembly of claim 15, wherein the recirculation channel comprises a channel inlet at the recess and a channel outlet at the upstream portion of the hub, the recirculation channel configured to guide a recirculation flow from the channel inlet, through the hub, to the channel outlet.

17. The assembly of claim 16, wherein the channel outlet is configured to direct the recirculation flow towards a center axis of an axial fan disposed upstream of the hub.

18. The assembly of claim 17, wherein the channel outlet is further configured to swirl the recirculation flow in a direction of rotation of the axial fan.

19. The assembly of claim 18, wherein the channel outlet further comprises one or more vanes.

20. The assembly of claim 17, wherein the hub further comprises a plurality of recirculation channels, including the recirculation channel, each recirculation channel of the plurality of recirculation channels having a channel inlet at the recess and a channel outlet at the upstream portion of the hub, the plurality of recirculation channels configured to guide a recirculation flow from the channel inlets, through the hub, to the channel outlets.

21. The assembly of claim 20, wherein the channel outlets are angled towards a direction of rotation of the axial fan, the channel outlets are configured to eject the recirculation flow toward the axial fan in the direction of rotation of the axial fan.

* * * * *